US010089927B2

(12) United States Patent
Sarma et al.

(10) Patent No.: US 10,089,927 B2
(45) **Date of Patent: *Oct. 2, 2018**

(54) ACTIVE MATRIX ORGANIC LIGHT EMITTING DIODE DISPLAY

(71) Applicant: HONEYWELL INTERNATIONAL INC., Morris Plains, NJ (US)

(72) Inventors: Kalluri R. Sarma, Mesa, AZ (US); Jerry A. Roush, Phoenix, AZ (US); John Schmidt, Phoenix, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/283,620

(22) Filed: Oct. 3, 2016

(65) Prior Publication Data

US 2017/0025064 A1 Jan. 26, 2017

Related U.S. Application Data

(62) Division of application No. 12/107,271, filed on Apr. 22, 2008, now Pat. No. 9,489,886, which is a division (Continued)

(51) Int. Cl.
*G09G 3/30* (2006.01)
*G09G 3/3233* (2016.01)

(52) U.S. Cl.
CPC ..... *G09G 3/3233* (2013.01); *G09G 3/30* (2013.01); *G09G 2300/0842* (2013.01);

(Continued)

(58) Field of Classification Search
CPC .... G09G 3/30; G09G 3/3233; G09G 2310/06; G09G 2300/0842; G09G 2300/0861;

(Continued)

(56) References Cited

U.S. PATENT DOCUMENTS 6,229,506 B1 5/2001 Dawson et al.
7,015,884 B2 3/2006 Kwon (Continued)

FOREIGN PATENT DOCUMENTS

CN 1479270 A 3/2004
CN 1174356 C 11/2004

(Continued)

OTHER PUBLICATIONS

Chinese Office Action for Application No. 201510135241.1 dated Oct. 8, 2016.

(Continued)

*Primary Examiner* — Jimmy H Nguyen
(74) *Attorney, Agent, or Firm* — Lorenz & Kopf, LLP

(57) ABSTRACT

An improved AM OLED pixel circuit and method of wide dynamic range dimming for AM OLED displays are disclosed that maintain color balance throughout the dimming range, and also maintain the uniformity of the luminance and chromaticity of the display at low gray-levels as the display is dimmed to lower luminance values. As such, AM OLED displays can meet the stringent color/dimming specifications required for existing and future avionics, cockpit, and hand-held military device display applications. Essentially, the OLED pixel circuit and method of dimming that are disclosed use Pulse Width Modulation (PWM) of the OLED pixel current to achieve the desired display luminance. Two example circuits are disclosed that externally PW modulate the common cathode voltage or common power supply voltage to modulate the OLED current in order to achieve the desired display luminance. Three example circuits are disclosed that incorporate additional transistor switches in the pixel circuit to modulate the OLED current during the frame time. By PWM of the OLED current, in combination with data voltage (or current) modulation, wide dynamic (Continued)

range dimming can be achieved while maintaining the color balance and the luminance and chromaticity uniformity required over the surface of the display involved.

12 Claims, 5 Drawing Sheets

Related U.S. Application Data of application No. 11/043,657, filed on Jan. 26, 2005, now abandoned.

(52) U.S. Cl.
CPC . *G09G 2300/0861* (2013.01); *G09G 2310/06* (2013.01); *G09G 2320/0233* (2013.01); *G09G 2320/0606* (2013.01); *G09G 2320/0626* (2013.01)

(58) Field of Classification Search
CPC ... G09G 2320/0233; G09G 2320/0606; G09G 2320/0626
USPC ..... 345/76–83, 36, 39, 44–46, 690–693; 315/169.3; 313/463
See application file for complete search history.

(56) References Cited

U.S. PATENT DOCUMENTS

| | | | |
|---|---|---|---|
| 7,109,952 | B2 | 9/2006 | Kwon |
| 7,199,768 | B2 | 4/2007 | Ono et al. |
| 7,365,742 | B2 | 4/2008 | Kim et al. |
| 7,612,749 | B2 | 11/2009 | Libsch et al. |
| 2003/0016190 | A1 | 1/2003 | Kondo |
| 2003/0063078 | A1 | 4/2003 | Hanari et al. |
| 2003/0095087 | A1 | 5/2003 | Libsch et al. |
| 2003/0227262 | A1 | 12/2003 | Kwon |
| 2004/0041525 | A1 | 3/2004 | Park et al. |
| 2004/0174354 | A1 | 9/2004 | Ono et al. |
| 2004/0246202 | A1 | 12/2004 | Yamashita |

FOREIGN PATENT DOCUMENTS

| | | | |
|---|---|---|---|
| CN | 1558390 | | 12/2004 |
| EP | 1197943 | A2 | 4/2002 |
| JP | 2001042822 | | 2/2001 |
| JP | 2001142427 | A | 5/2001 |
| JP | 2003108073 | | 4/2003 |
| KR | 20030027804 | A | 4/2003 |
| TW | 200414809 | | 8/2004 |
| TW | I229568 | B | 3/2005 |

OTHER PUBLICATIONS

CN Office Action, 200680009664.8 dated Sep. 25, 2009.
CN Office Action, 200680009664.8 dated Aug. 2, 2010.
CN Office Action, 200680009664.8 dated Jan. 31, 2011.
Yuasa and Hara, letter regarding JP Office action for JP 2007-553116 dated Nov. 4, 2011.
KR Office Action, KR 10-2007-7017359, dated Apr. 3, 2012.
EP Examination Report for EP 06 717 786.5 dated Jul. 18, 2012.
CN Notice of Reexamination, 200680009664.8 dated Jul. 17, 2012.
JPO, Japanese Office Action for Application No. 2007553116, dated Oct. 17, 2012.
KIPO Office Action for application No. 10-2007-7017359 dated Nov. 27, 2012.
CN Office Action for Application No. 200680009664.8 dated Jan. 18, 2013.
JP Office Action, JP 2006 80009664.8 dated Jan. 18, 2013.
EP Examination Report for EP 06 717 786.5 dated Mar. 25, 2013.
JP Office Action for Application No. 095102411 dated Apr. 15, 2013.
EP Communication for Application No. 06717786.5-1904 dated Jul. 23, 2013.
CN Office Action for Application No. 200680009664.8 dated Aug. 30, 2013.
CN Reexamination Notice for Application No. 200680009664.8 dated Aug. 26, 2014.

ACTIVE MATRIX ORGANIC LIGHT EMITTING DIODE DISPLAY

CROSS REFERENCE TO RELATED APPLICATION

This application is a continuation of Ser. No. 12/107,271 filed Apr. 22, 2008, which is a divisional of Ser. No. 11/043,657 filed on Jan. 26, 2005.

BACKGROUND OF THE INVENTION

Technical Field

The present invention relates generally to the field of flat panel displays, and more specifically, but not exclusively, to an improved Active Matrix Organic Light Emitting Diode (AM OLED) display and method of wide dynamic range dimming in such a display for commercial and military applications, such as, for example, cockpit displays, avionics displays, or hand-held military communication device displays.

Description of Related Art

AM OLED displays are an emerging flat panel display technology, which has already produced such new products as passive matrix-addressed displays that can be used for cell-phones and automobile audio systems. AM OLED displays are most likely to replace backlit AM Liquid Crystal Displays (LCDs) because AM OLED displays are more power efficient, rugged, weigh less, cost less, and have much better image quality than existing AM LCDs. As such, the market for AM OLED-based displays is estimated to reach about $1.7 B per year by 2006.

Cockpit display applications are relatively demanding for existing display technologies, because of the stringent requirements imposed with respect to image quality and the need for superior operational performance within a broad range of environments, such as high temperature, humidity, and ambient lighting environments. For the better part of the past ten years, AM LCDs have replaced Cathode Ray Tube (CRT) displays in cockpit applications, because of the advantages of AM LCDs over CRT displays in terms of lower weight, flatter form factor, less power consumption, the use of large active areas with relatively small bezels, higher reliability, higher luminance, greater luminance uniformity, wider dimming range, and better sunlight readability. As such, AM LCDs have been the displays of choice for cockpit and avionics display applications for a number of years.

A significant problem that exists with AM LCDs for display applications (e.g., cockpit, avionics and hand-held device displays) is that the backlighting of the AM LCDs adds a significant amount of weight and volume to these types of displays. However, an advantage of this backlighting feature of AM LCDs is that it provides a highly controllable function for (independently) dimming the display in order to achieve optimum performance over a range of ambient lighting conditions. Some critical display applications (e.g., avionics and certain military device displays) require wide dynamic ranges of dimming (e.g., >2000:1) for the display to be viewed comfortably in both daytime (bright) and night-time (dark) viewing conditions. Currently, this dimming function can be accomplished with AM LCDs by dimming the display backlight (through a large dynamic range), while maintaining the AM LCD's optimized driving conditions.

The weight and volume problems that exist with AM LCDs for avionics or hand-held device applications, for example, can be alleviated with AM OLED displays. Compared to AM LCDs, AM OLED displays offer such significant advantages as wider viewing angles, lower power consumption, lighter weight, superior response time, superior image quality, and lower cost. However, a drawback of the existing AM OLED displays is that they are not easily dimmable (i.e., their brightness adjusted) to the desired luminance levels, except by changing the driving conditions of the AM OLED displays, or by varying the anode ($V_{DD}$) and/or cathode ($V_K$) voltages.

Generally, the existing AM OLED displays' grayscale driving conditions are optimized for "normal" daytime (bright ambient) viewing conditions. However, changing either the grayscale driving conditions or the $V_{DD}/V_K$ voltages of AM OLED displays to achieve lower display luminance levels for night (dark ambient) conditions using a conventional AM OLED display results in luminance and color non-uniformities across the surfaces of these displays.

As such, an important requirement imposed on AM OLED displays in such critical applications as cockpit displays, avionics displays, or military hand-held device displays is that such displays have to be capable of adjusting their luminance (brightness) over a wide dynamic range (e.g., >2000:1) without affecting the color balance and/or the uniformity of the luminance and chromaticity across the surface of the display as the display is being dimmed. The drive methods used for existing AM OLED displays achieve the desired luminance by adjusting the grayscale data voltage (or current) or $V_{DD}/V_K$ voltage(s). However, these existing methods of adjusting the luminance of AM OLED displays create numerous problems for wide dynamic range display dimming applications, such as: (1) it is a relatively difficult problem to achieve the desired wide dynamic range dimming requirements with the existing driving methods using 8-bit data (column) drivers currently available for AM OLED displays; (2) when the grayscale data voltages (or currents) or the $V_{DD}/V_K$ voltages, which are optimized for "normal" daylight operation, are changed (e.g., reduced) for night-time (low luminance) operation, typically the display color balance is changed due to the different transfer characteristics (luminance versus voltage) for the Red, Green and Blue (R, G, B) AM OLED display materials used; and (3) operation of the existing AM OLED displays at the low luminance levels associated with night-time viewing conditions results in significant non-uniformities in the luminance and chromaticity across the surface of the displays due to increased variations in the Thin-Film Transistor (TFT) and OLED performance in the low luminance (gray-level) regime.

As such, to illustrate these problems with existing AM OLED displays, FIG. 1 depicts an electrical schematic diagram of a typical AM OLED sub-pixel circuit 100 (labeled "Prior Art"), which is currently used in a conventional method for dimming an AM OLED display. Referring to FIG. 1, conventional sub-pixel circuit 100 includes a first TFT 102, a second TFT 104, a storage capacitor 106, and an OLED pixel 108. As shown, transistor 102 is a scan transistor, and transistor 104 is a drive transistor. The gate terminal 110 of the scan transistor 102 is connected to the row (scan/row enable) address bus of the display involved, and the drain terminal 112 of scan transistor 102 is connected to the column (data) address bus of the display. The source of scan transistor 102 is connected to the node 107 at the storage capacitor 106 and the gate terminal of the drive transistor 104. During the row addressing time period of the display operation, scan transistor 102 charges the node 107 at the storage capacitor 106 and the gate terminal of the drive transistor 104 to the data voltage (signal), $V_{DATA}$. After the row addressing time period, scan transistor 102 is switched off, and the OLED pixel 108 is electrically isolated from the data bus. During the remainder of the frame time, the power supply voltage, $V_{DD}$, which is connected to the drain terminal 114 of the drive transistor 104, provides the current for driving the OLED pixel 108.

The grayscale from this conventional method in the AM OLED display circuit 100 depicted in FIG. 1 is achieved by varying the data voltages (signals) on the data bus. In addition, the brightness (maximum luminance) of the display is adjusted (for display dimming) directly by changing the data voltages (signals) or $V_{DD}/V_K$ voltages. However, as discussed earlier, it can be seen from FIG. 1 that a significant problem with these conventional methods of adjusting the luminance of an AM OLED display is that because the dimming is performed by changing the data voltage (or current), or by changing the power supply ($V_{DD}$ and/or $V_K$) voltages to adjust the grayscale, wide dynamic range dimming (e.g., >2000:1) cannot be achieved with suitable uniformity. Nevertheless, as described in detail below, the present invention provides an improved AM OLED display and method of adjusting luminance with superior dimming capability (e.g., wide dynamic range >2000:1) that resolves the problems encountered with existing AM OLED displays and other prior art displays.

SUMMARY OF THE INVENTION

The present invention provides an improved AM OLED pixel circuit and method of wide dynamic range dimming for AM OLED displays that maintains color balance throughout the dimming range, and also maintains the uniformity of the luminance and chromaticity of the display at low gray-levels as the display is dimmed to lower luminance values. As such, the present invention enables AM OLED displays to meet the stringent color/dimming specifications required for existing and future avionics, cockpit, and hand-held military device display applications. Essentially, the present invention provides an improved AM OLED pixel circuit and method of dynamic range dimming that uses Pulse Width Modulation (PWM) of the OLED pixel current to achieve the desired display luminance (brightness).

Two example embodiments of the invention are provided for externally (e.g., outside an AM OLED glass display) PW modulating the common cathode voltage ($V_K$) or common power supply voltage ($V_{DD}$) so as to modulate the OLED current in order to achieve the desired display luminance. Three additional example embodiments of the invention are provided that incorporate additional transistor switches in the pixel circuit in order to modulate the OLED current during the frame time. Unlike the conventional methods, the three additional (internal) example embodiments allow modulation of each row of pixels sequentially during the frame time, which eliminates any propensity for display flicker. Thus, by PW modulating the OLED current, in combination with data voltage (or current) modulation, the present invention achieves wide dynamic range dimming while maintaining the color balance and the luminance and chromaticity uniformity required over the surface of the display involved.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 2A:
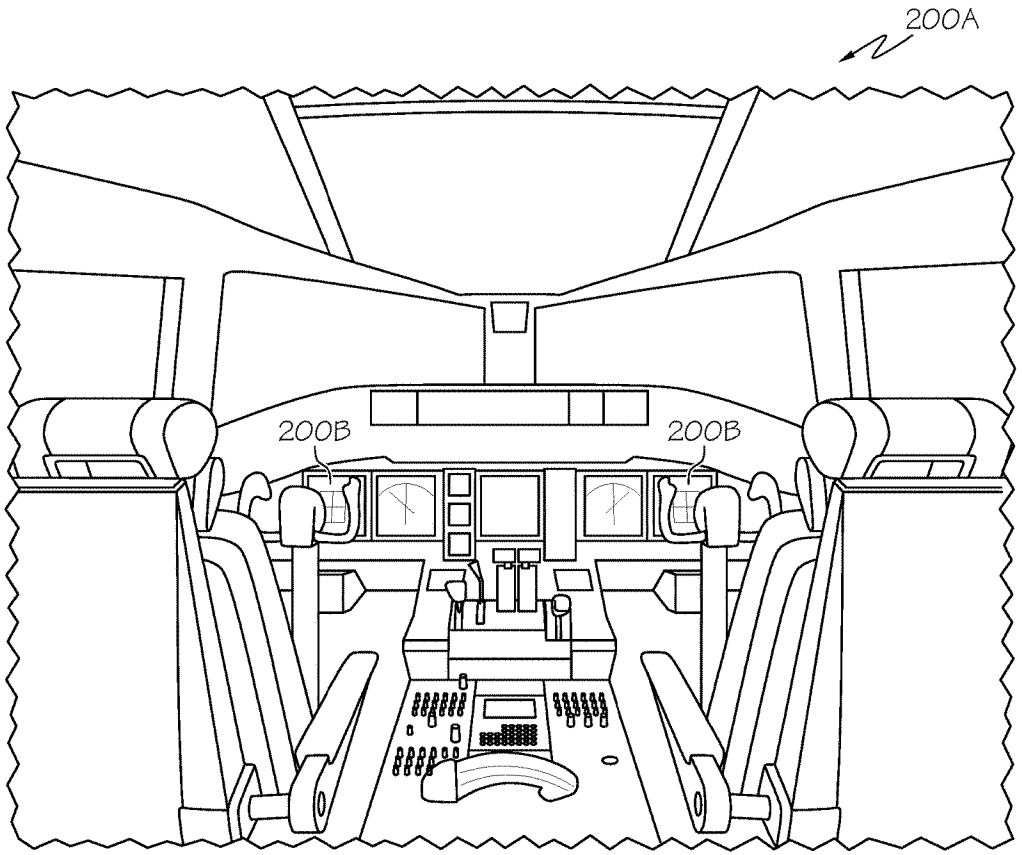
FIG. 2A depicts a pictorial representation of an example cockpit or avionics display environment, which may be used as an environment to implement one or more embodiments of the present invention.
Figure 2B:
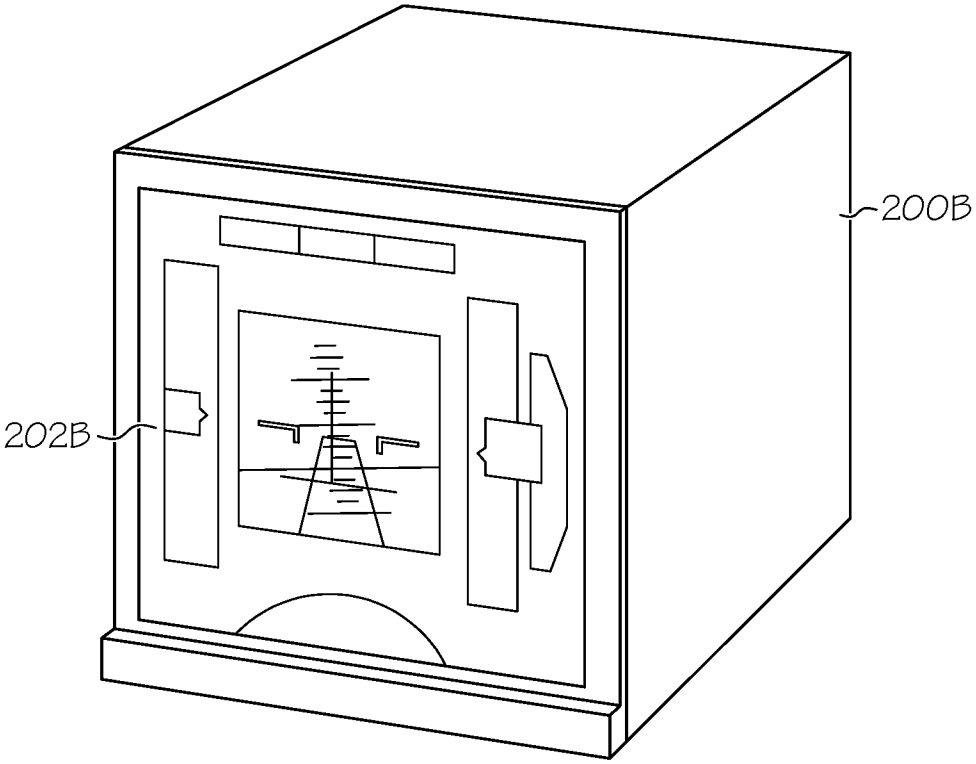
FIG. 2B depicts a pictorial representation of an example cockpit or avionics display, in which one or more embodiments of the present invention may be implemented.

With reference now to the figures, FIG. 2A depicts a pictorial representation of an example cockpit or avionics display environment 200A, which may be used as an environment to implement one or more embodiments of the present invention. FIG. 2B depicts a pictorial representation of an example cockpit or avionics display 200B (e.g., from within the example environment 200A) including an example display 202B, in which one or more embodiments of the present invention may be implemented. As such, although FIGS. 2A and 2B depict an exemplary environment and avionics or cockpit display, the present invention is not intended to be so limited and can be implemented in any suitable display requiring, for example, wide dynamic range dimming (e.g., military or commercial hand-held device with flat panel display, etc.).

Figure 1:
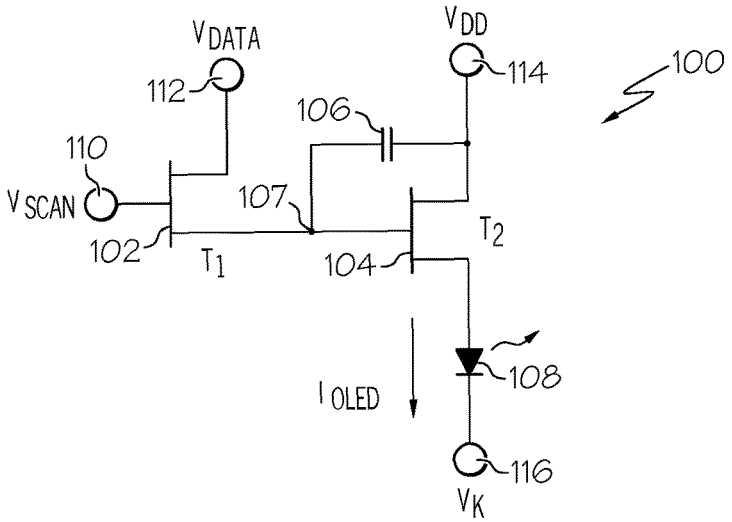
FIG. 1 (PRIOR ART)
FIG. 1 depicts an electrical schematic diagram of a prior art AM OLED sub-pixel circuit, which is currently used in a conventional method for dimming an AM OLED display.
Figure 3:
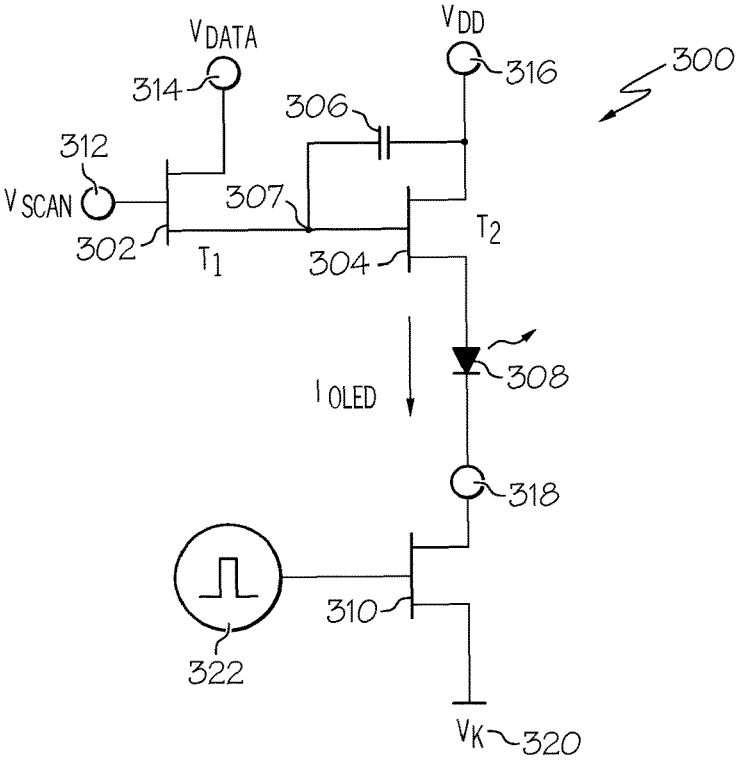
FIG. 3 depicts an electrical schematic diagram of an example AM OLED sub-pixel circuit, which can be used to implement a first embodiment of the present invention.

FIG. 3 depicts an electrical schematic diagram of an example AM OLED sub-pixel circuit 300, which can be used to implement a first embodiment of the present invention. As such, AM OLED sub-pixel circuit 300 can be used in a preferred method for dynamically dimming an AM OLED display using, for example, an external (to the display) PWM scheme. Referring now to FIG. 3, AM OLED sub-pixel circuit 300 includes a first TFT 302, a second TFT 304, a storage capacitor 306, an OLED pixel 308, and a transistor 310, represented here by a Field Effect Transistor (FET). As shown, transistor 302 is a scan transistor, and transistor 304 is a drive transistor. The gate terminal 312 of the scan transistor 302 is connected to the row (scan/row enable) address bus of the display involved, and the drain terminal 314 of scan transistor 302 is connected to the column (data) address bus of the display. The source of scan transistor 302 is connected to the node 307 at the storage capacitor 306 and the gate terminal of the drive transistor 304. The source of drive transistor 304 is connected to a terminal of OLED pixel 308. The second terminal 318 of OLED pixel 308 is connected to one (e.g. drain) terminal of transistor 310. The other (e.g. source) terminal of transistor 310 is connected to a common cathode terminal, $V_K$ 320.

For this exemplary embodiment, an AM OLED display incorporating AM OLED pixel circuit 300 can include a plurality of (e.g., two or more) common cathode terminals, $V_K$ 320. One such common cathode terminal, $V_K$ 320, can be used to cover a top half of the display rows on the display involved, and another common cathode terminal, $V_K$ 320, can be used to cover a bottom half of the display rows on the display involved. For example, a display can include 480 rows and 640 columns. Each of the common cathode terminals, $V_K$ 320, in such an AM OLED display can be switched to the cathode voltage through the transistor 310 controlled by a PWM signal generator 322. An example frequency for a PWM signal from generator 322 is 60 Hz.

During the row addressing time period of the display operation, scan transistor 302 charges the node 307 at the storage capacitor 306 and the gate terminal of the drive transistor 304 to the data voltage (signal), $V_{DATA}$. After the row addressing time period, scan transistor 302 is switched off, and the OLED pixel 308 is electrically isolated from the data bus.

For this exemplary embodiment, the common cathode voltage, $V_K$ 320, is PW modulated by the signal applied from PWM signal generator 322, which functions to apply a reverse bias across the row(s) of OLED pixels (e.g., OLED pixel 308) associated with this common cathode terminal, $V_K$ 320, which in turn, switches "off" the OLED pixels (e.g., OLED pixel 308) associated with this common cathode terminal, $V_K$ 320, in order to control the brightness or luminance during the frame time of the display involved. Thus, in accordance with this embodiment of the present invention, an AM OLED pixel circuit and method are provided for achieving wide dynamic range dimming while maintaining the color balance and the luminance and chromaticity uniformity required over the surface of the display involved. In this case, an external transistor 310 can be used to modulate the cathode power supply, $V_K$ 320, of the OLED pixel 308 in order to dynamically dim the display. Thus, by PW modulating the common cathode voltage, $V_K$ 320, the luminance or brightness of the display is averaged over a suitable period of time. Therefore, using the PWM method of the present invention allows significantly more uniform dimming of OLED displays than currently provided for the existing OLED displays.

Figure 4:
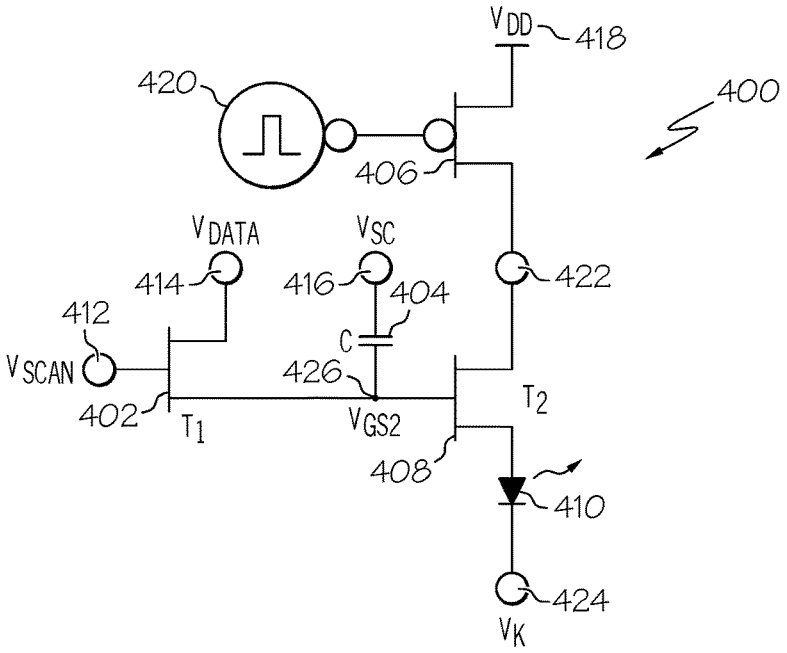
FIG. 4 depicts an electrical schematic diagram of an example AM OLED sub-pixel circuit, which can be used to implement a second embodiment of the present invention.

FIG. 4 depicts an electrical schematic diagram of an example AM OLED sub-pixel circuit 400, which can be used to implement a second embodiment of the present invention. As such, AM OLED sub-pixel circuit 400 can be used in a preferred method for dynamically dimming an AM OLED display using, for example, an external (to the display) PWM scheme. Referring now to FIG. 4, AM OLED sub-pixel circuit 400 includes a first TFT 402, a storage capacitor 404, a second TFT 408, an OLED pixel 410, and a transistor 406 represented here by a P-channel FET. In this case, an external (to the display involved) transistor 406 can be used to PW modulate the positive power supply, $V_{DD}$ 418, of the OLED pixel 410, in order to turn "off" the voltage across the OLED pixels (e.g., OLED pixel 410) associated with the common power supply voltage, $V_{DD}$ 418, and thus to control the brightness of the display. Also, in this case, the reference voltage, $V_{SC}$ 416, for storage capacitor 404, can be removed from the $V_{DD}$ line to prevent coupling the PW modulated $V_{DD}$ to the gate voltage, $V_{GS2}$, at the node 426 between the gate terminal of transistor 408 and storage capacitor 404.

As shown, for this example embodiment, transistor 402 is a scan transistor, and transistor 408 is a drive transistor. The gate terminal 412 of the scan transistor 402 is connected to the row (scan/row enable) address bus of the display involved, and the drain terminal 414 of scan transistor 402 is connected to the column (data) address bus of the display. The source of scan transistor 402 is connected to the node 426 at the storage capacitor 404 and the gate terminal of the drive transistor 408. The source of drive transistor 408 is connected to a terminal of OLED pixel 410. The drain of drive transistor 408 is connected to one (e.g. the drain) terminal 422 of the transistor 406, and the other (e.g. the source) terminal of transistor 406 is connected to the common power supply voltage, $V_{DD}$ 418. The second terminal of OLED pixel 410 is connected to a common cathode terminal, $V_K$ 424.

For this exemplary embodiment, an AM OLED display incorporating AM OLED sub-pixel circuit 400 can include a plurality of (e.g., two or more) common power supply voltage terminals, $V_{DD}$ 418. Each one of the common power supply voltages (e.g., $V_{DD}$ 418 in FIG. 4) provides the positive power supply voltage for the particular OLED sub-pixel involved (e.g., OLED 410) within the overall display. The control (e.g. gate) terminal of transistor 406 in such a display is connected to a PWM signal generator 420.

During the row addressing time period of the display operation, scan transistor 412 charges the node 426 at the storage capacitor 404 and the gate terminal of the drive transistor 408 to the data voltage (signal), $V_{DATA}$. After the row addressing time period, scan transistor 412 is switched off, and the OLED pixel 410 is electrically isolated from the data bus. Then, in order to adjust the luminance (e.g., brightness) of the display (e.g., OLED pixel 410), the PW modulated signal from PWM signal generator 420 is applied to the gate of the switch transistor 406, which PW modulates the common power supply voltage, $V_{DD}$ 418, to turn "off" the voltage across the plurality of OLED pixels (e.g., OLED pixel 410) associated with the common power supply voltage, $V_{DD}$ 418, and thus control the brightness of the overall display. Again, using the PWM method of the present invention, the dimming of the display can be achieved with optimum uniformity.

Figure 5:
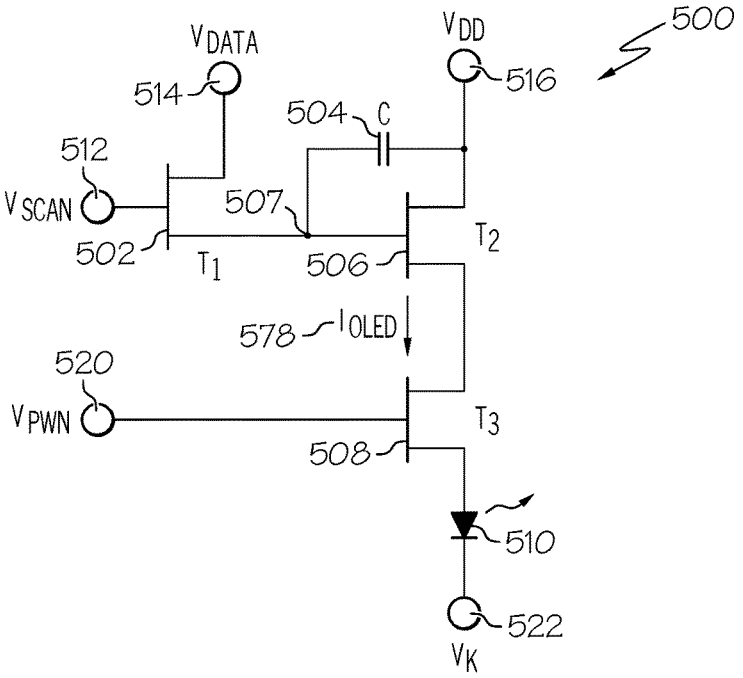
FIG. 5 depicts an electrical schematic diagram of an example AM OLED sub-pixel circuit, which can be used to implement a third embodiment of the present invention.

FIG. 5 depicts an electrical schematic diagram of an example AM OLED sub-pixel circuit 500, which can be used to implement a third embodiment of the present invention. As such, AM OLED sub-pixel circuit 500 can be used in a preferred method for dynamically dimming an AM OLED display using, for example, an internal (to the display) PWM scheme. Referring now to FIG. 5, AM OLED sub-pixel circuit 500 includes a first TFT 502, a storage capacitor 504, a second TFT 506, a third TFT 508, and an OLED pixel 510. In this case, a third TFT 508 (internal to the display involved) can be used at each sub-pixel in the display to PW modulate the current, $I_{OLED}$ 518, of the OLED pixel 510, in order to turn "off" the OLED pixel (e.g., OLED pixel 510) so that it does not emit light, and thus control the brightness of the overall display.

As shown, for this example embodiment, transistor 502 is a scan transistor, and transistor 506 is a drive transistor. The gate terminal 512 of the scan transistor 502 is connected to the row (scan/row enable) address bus of the display involved, and the drain terminal 514 of scan transistor 502 is connected to the column (data) address bus of the display. The source of scan transistor 502 is connected to the node 507 at the storage capacitor 504 and the gate terminal of the drive transistor 506. The source of drive transistor 506 is connected to the drain of the third TFT 508, and the source of third TFT 508 is connected to a terminal of OLED pixel 510. The drain of drive transistor 506 is connected to the common power supply voltage, $V_{DD}$ 516. The second terminal of OLED pixel 510 is connected to a common cathode terminal, $V_K$ 522.

For this exemplary embodiment, an AM OLED display incorporating AM OLED sub-pixel circuit 500 can include a plurality of (e.g., two or more) PWM voltage signal generators, $V_{PWM}$ 520. Thus, by pixel switching or PWM of the third TFT 508, the third TFT 508 controls the OLED current $I_{OLED}$ 518 and switches "off" the OLED pixel involved (e.g., OLED pixel 510 in FIG. 5) so that the OLED pixel involved does not emit light.

Specifically, the gate terminal of the switching TFT 508, in each of the pixels in a given row in the display, is connected to a row bus that is addressable from outside the display, as is the row-enable bus. The PW modulated signal, $V_{PWM}$, from the PWM voltage signal generator 520, is applied to each row in order to switch "off" the current flow to the OLED pixel 510 and turn the pixel "off". The "on" time of each of the rows is modulated to control the brightness of the display. A significant amount of modulation (e.g., dimming) can be achieved using such an internal modulation scheme.

For example, in a 1000 line (rows) display, the brightness of the display can be modulated (dimmed) by a factor of 1000:1 by the preset PWM method alone, and allowing the desired wide dynamic range dimming (e.g., >2000:1) to be accomplished using gray-levels with higher luminance values. Thus, the present invention significantly improves the uniformity of the luminance and chromaticity across the surface of the display as it is being dimmed, as compared to the conventional dimming methods used for AM OLED displays.

As such, the PWM voltage signal generator 520 can be commonly connected to all of the pixels in the display, or each row of pixels can be provided with an independent PWM signal generator (e.g., such as PWM voltage signal generator 520). Incidentally, an advantage of providing each row of pixels with a separate PWM voltage (e.g., $V_{PWM}$ 520), is that the display flicker can be significantly minimized in comparison to other approaches.

During the row addressing time period of the display operation, scan transistor 502 charges the node 507 at the storage capacitor 504 and the gate terminal of the drive transistor 506 to the data voltage (signal), $V_{DATA}$. After the row addressing time period, scan transistor 502 is switched off, and the OLED pixel 510 is electrically isolated from the data bus. Then, in order to adjust the luminance (e.g., brightness) of the display (e.g., OLED pixel 510), the PW modulated signal, $V_{PWM}$, from PWM voltage signal generator 520 is applied to the gate of the third TFT 508, which PW modulates the OLED current, $I_{OLED}$ 518, to turn "off" the subject OLED pixels (e.g., OLED pixel 510), and thus control the brightness of the overall display. Again, using the PWM method of the present invention, the dimming of the display can be achieved with optimum uniformity.

Figure 6:
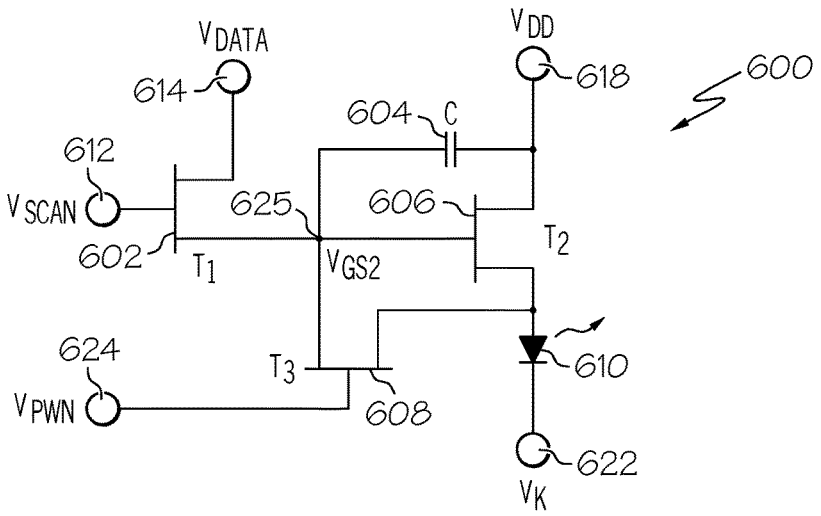
FIG. 6 depicts an electrical schematic diagram of an example AM OLED sub-pixel circuit, which can be used to implement a fourth embodiment of the present invention.

FIG. 6 depicts an electrical schematic diagram of an example AM OLED sub-pixel circuit 600, which can be used to implement a fourth embodiment of the present invention. As such, AM OLED sub-pixel circuit 600 can be used in a preferred method for dynamically dimming an AM OLED display using, for example, an internal (to the display) PWM scheme. Referring now to FIG. 6, AM OLED sub-pixel circuit 600 includes a first TFT 602, a storage capacitor 604, a second TFT 606, a third TFT 608, and an OLED pixel 610. In this case, a third TFT 608 (internal to the display involved) can be used at each sub-pixel in the display to PW modulate the current through the OLED pixel involved in order to turn "off" that OLED pixel (e.g., OLED pixel 610) so that it does not emit light, and thus control the brightness of the overall display.

As shown, for this example embodiment, transistor 602 is a scan transistor, and transistor 606 is a drive transistor. The gate terminal 612 of the scan transistor 602 is connected to the row (scan/row enable) address bus of the display involved, and the drain terminal 614 of scan transistor 602 is connected to the column (data) address bus of the display. The source of scan transistor 602 is connected to the node 620 at the storage capacitor 604, the drain of third TFT 608, and the gate terminal of the drive transistor 606. The source of the drive transistor 606 is connected to the source of the third TFT 608 and one terminal of OLED pixel 610. The drain terminal of drive transistor 606 is connected to the common power supply voltage, $V_{DD}$ 618. The second terminal of OLED pixel 610 is connected to a common cathode terminal, $V_K$ 622.

For this exemplary embodiment, an AM OLED display incorporating AM OLED sub-pixel circuit 600 can include a plurality of (e.g., two or more) PWM voltage signal generators, $V_{PWM}$ 624. Thus, by PWM of the gate voltage, $V_{GS2}$ 620, at the gate of the drive transistor 606, the third TFT 608 can control the current through the OLED pixel involved (e.g., OLED pixel 610) by turning "off" the drive transistor 606 and, therefore, turning "off" the OLED pixel involved (e.g., OLED pixel 610 in FIG. 6) so that the OLED pixel involved does not emit light. As such, the PWM voltage signal generator 624 can be common to all of the pixels in the display, or each row of pixels can be provided with an independent PWM signal generator (e.g., such as PWM voltage signal generator 624). Once again, an advantage of providing each row of pixels with a separate PWM voltage (e.g., $V_{PWM}$ 624), is that the present method can significantly reduce the display's propensity for flicker in comparison with other existing approaches.

During the row addressing time period of the display operation, scan transistor 602 charges the node 620 at the storage capacitor 604 and the gate terminal of the drive transistor 606 to the data voltage (signal), $V_{DATA}$. After the row addressing time period, scan transistor 602 is switched off, and the OLED pixel 610 is electrically isolated from the data bus. Then, in order to adjust the luminance (e.g., brightness) of the display (e.g., OLED pixel 610), the PW modulated signal, $V_{PWM}$, from PWM voltage signal generator 624 is applied to the gate of the third TFT 608, which PW modulates the gate voltage, $V_{GS2}$ 620, and turns "off" the drive transistor 606. In response, PW modulation of the drive transistor 606 controls the current through the OLED pixel involved, and turns "off" the subject OLED pixel (e.g., OLED pixel 610) to control the brightness of the overall display. Again, using the PWM method of the present invention, the dimming of the display can be achieved with optimum uniformity.

Figure 7:
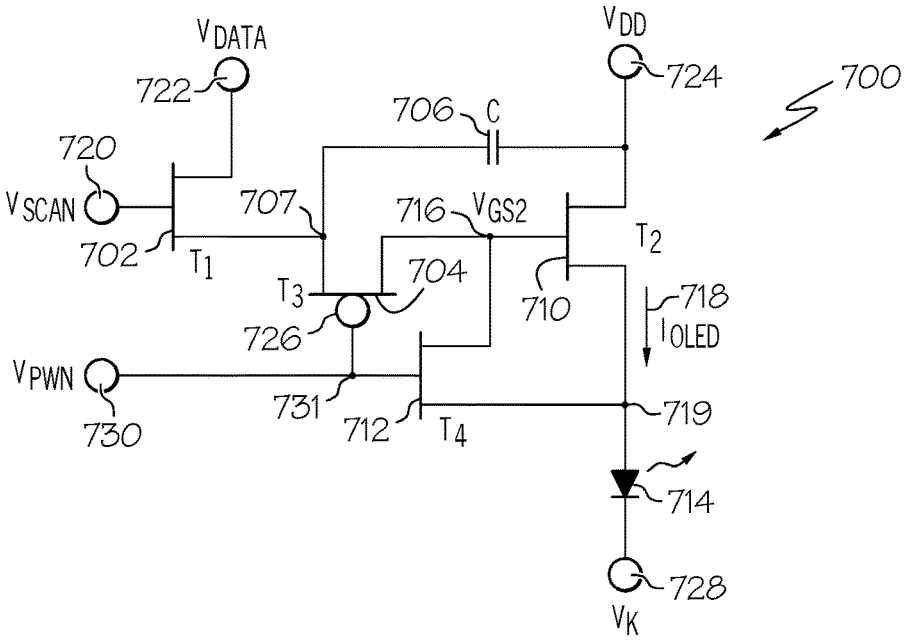
FIG. 7 depicts an electrical schematic diagram of an example AM OLED sub-pixel circuit, which can be used to implement a fifth embodiment of the present invention.

FIG. 7 depicts an electrical schematic diagram of an example AM OLED sub-pixel circuit 700, which can be used to implement a fifth embodiment of the present invention. As such, AM OLED sub-pixel circuit 700 can be used in a preferred method for dynamically dimming an AM OLED display using, for example, an internal (to the display) PWM scheme. Referring now to FIG. 7, AM OLED sub-pixel circuit 700 includes a first TFT 702, a storage capacitor 706, a second TFT 710, a third TFT 704, a fourth TFT 712, and an OLED pixel 714. In this case, two additional transistors (e.g., third TFT 704 and fourth TFT 712), which are both internal to the display involved, can be used at each sub-pixel in the display to enable PWM of the current through the OLED pixel involved (e.g., $I_{OLED}$ 718), in order to turn "off" that OLED pixel (e.g., OLED pixel 714) so that it does not emit light, by changing the gate voltage, $V_{GS2}$ 716, from a pre-selected value to "off". At a selected time after the storage capacitor 706 is charged to the pre-selected value, the PWM voltage, $V_{PWM}$ 730, goes high, which shuts "off" third TFT 704 and (e.g., disconnecting $V_C$ 706 from $V_{GS2}$ 716) and turns "on" fourth TFT 712, which in turn, shuts "off" drive transistor 710. This PWM method of the present invention thus controls the current through the OLED pixel 714 involved (e.g., $I_{OLED}$ 718), which controls the brightness of the overall display.

As mentioned earlier, a significant advantage of providing each row of pixels with a separate PWM voltage (e.g., $V_{PWM}$ 730), is that the present method can significantly reduce the display's propensity for flicker in comparison with other existing approaches. Also, using the PWM method of the present invention, the dimming of the AM OLED display can be achieved with optimum uniformity.

It is important to note that while the present invention has been described in the context of a fully functioning AM OLED display, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular AM OLED display.

The description of the present invention has been presented for purposes of illustration and description, and is not intended to be exhaustive or limited to the invention in the form disclosed. Many modifications and variations will be apparent to those of ordinary skill in the art. These embodiments were chosen and described in order to best explain the principles of the invention, the practical application, and to enable others of ordinary skill in the art to understand the invention for various embodiments with various modifications as are suited to the particular use contemplated.

What is claimed is:

1. An Organic Light Emitting Diode display, comprising:

a plurality of rows of Organic Light Emitting Diodes coupled to a power supply;

a plurality of Pulse Width Modulation signal generators; and at least one circuit comprising:

a first transistor, said first transistor coupled to a row address bus of said display and a column address bus of said display;

a second transistor, said second transistor coupled to said first transistor and coupled directly to one Organic Light Emitting Diode of said plurality of rows of Organic Light Emitting Diodes;

a storage capacitor, said storage capacitor coupled to said first transistor and said second transistor;

a third transistor, said third transistor coupled to the one Organic Light Emitting Diode of said plurality of rows of Organic Light Emitting Diodes and to one of said Pulse Width Modulation signal generators such that the third transistor is configured to Pulse Width Modulate a current through a selected one of said rows of Organic Light Emitting Diodes and control a light emission thereof, said third transistor further directly coupled to said first transistor, said second transistor, and said storage capacitor, and a fourth transistor, said fourth transistor directly coupled to said third transistor, said second transistor, the one of said Organic Light Emitting Diodes, and the one of said Pulse Width Modulation signal generators, wherein a gate of said fourth transistor is directly coupled to a gate of the third transistor, said fourth transistor operable to further control said light emission of said Organic Light Emitting Diode in cooperation with the third transistor.

2. The Organic Light Emitting Diode display of claim 1, wherein said first transistor comprises a Thin-Film Transistor.

3. The Organic Light Emitting Diode display of claim 1, wherein said second transistor comprises a Thin-Film Transistor.

4. The Organic Light Emitting Diode display of claim 1, wherein said third transistor comprises a Field-Effect Transistor.

5. The Organic Light Emitting Diode display of claim 1, wherein said third transistor comprises a Thin-Film Transistor.

6. The Organic Light Emitting Diode display of claim 1, wherein said third transistor comprises a Bipolar Transistor.

7. An Organic Light Emitting Diode display, comprising:

a plurality of rows of Organic Light Emitting Diodes pixels;

a plurality of Pulse Width Modulation signal generators; and at least one organic light emitting diode circuit comprising:

a first transistor, said first transistor coupled to a row address bus of said display and a column address bus of said display;

a second transistor, said second transistor coupled to said first transistor;

a third transistor, said third transistor coupled to said second transistor and to one Organic Light Emitting Diode of said of said plurality of rows of Organic Light Emitting Diode pixels, the third transistor configured to change a voltage applied to a gate of the second transistor, said third transistor further directly coupled to said first transistor and said second transistor;

a fourth transistor, said fourth transistor directly coupled to said third transistor, said second transistor, said one Organic Light Emitting Diode of said plurality of rows of Organic Light Emitting Diodes, and one of said Pulse Width Modulation signal generators, wherein a gate of said fourth transistor is directly coupled to a gate of the third transistor, said fourth transistor operable to further control said light emission of said one Organic Light Emitting Diode in cooperation with the third transistor;

a storage capacitor, said storage capacitor coupled to said first transistor, said second transistor, and said third transistor; and wherein one of said Pulse Width Modulation signal generators is coupled to said third transistor at each of said pixels in a row of Organic Light Emitting Diode pixels to Pulse Width Modulate a current through each of the Organic Light Emitting Diodes pixels in said row, and control a light emission thereof.

8. The Organic Light Emitting Diode display of claim 7, wherein said first, second, and third transistors comprise a Thin-Film Transistor.

9. The Organic Light Emitting Diode display of claim 7, wherein said third transistor comprises a Thin-Film Transistor.

10. An Organic Light Emitting Diode display, comprising:

a plurality of rows of Organic Light Emitting Diodes;

a plurality of Pulse Width Modulation signal generators;

at least one organic light emitting diode circuit comprising:

a first transistor, said first transistor coupled to a row address bus of said display and a column address bus of said display;

a second transistor, said second transistor directly coupled to one Organic Light Emitting Diode of said plurality of rows of Organic Light Emitting Diodes;

a third transistor, said third transistor coupled to the one Organic Light Emitting Diode of said rows of Organic Light Emitting Diodes, said third transistor further directly coupled to said first transistor and said second transistor;

a fourth transistor, said fourth transistor coupled to said first transistor via said third transistor, wherein a gate of said third transistor is directly connected to a gate of the fourth transistor;

a storage capacitor, said storage capacitor coupled to said first transistor, said second transistor, and directly to said third transistor; and wherein one of said Pulse Width Modulation signal generators is directly coupled to the said third transistor and the said fourth transistor at each of the pixels in a row of Organic Light Emitting Diode pixels to Pulse Width Modulate a current through each of the Organic Light Emitting Diodes at each of the pixels in the said row, and control a light emission thereof.

11. The Organic Light Emitting Diode display of claim 10, wherein said first, second, and third transistors comprise a Thin-Film Transistor.

12. The Organic Light Emitting Diode display of claim 10, wherein said third transistor comprises a Thin-Film Transistor.

* * * * *